US008292656B2

(12) United States Patent
Mydlarz

(10) Patent No.: US 8,292,656 B2
(45) Date of Patent: Oct. 23, 2012

(54) POWER OUTLET ORGANIZER

(76) Inventor: Michael Mydlarz, Stamford, CT (US)

( * ) Notice: Subject to any disclaimer, the term of this patent is extended or adjusted under 35 U.S.C. 154(b) by 0 days.

(21) Appl. No.: 12/567,850

(22) Filed: Sep. 28, 2009

(65) Prior Publication Data

US 2010/0081318 A1 Apr. 1, 2010

Related U.S. Application Data

(60) Provisional application No. 61/100,344, filed on Sep. 26, 2008.

(51) Int. Cl.
*H01R 13/72* (2006.01)

(52) U.S. Cl. ..... 439/501

(58) Field of Classification Search ..... 439/501, 439/502, 652, 372–373
See application file for complete search history.

(56) References Cited

U.S. PATENT DOCUMENTS 4,867,738 A * 9/1989 Mintz ..... 604/6.15
5,055,099 A * 10/1991 Mintz ..... 604/6.15
5,562,488 A * 10/1996 Neiser et al. ..... 439/501
5,593,316 A * 1/1997 Lyons ..... 439/501
5,825,295 A * 10/1998 Casady et al. ..... 340/602
5,917,694 A * 6/1999 Denny ..... 361/643
6,052,862 A * 4/2000 Lowery ..... 15/323
6,059,081 A * 5/2000 Patterson et al. ..... 191/12.2 R
6,969,275 B1 * 11/2005 Brock ..... 439/502
2006/0104836 A1 * 5/2006 Phillips ..... 417/411
2007/0159772 A1 * 7/2007 Morice ..... 361/600
2007/0267550 A1 * 11/2007 Blankenship et al. ..... 248/125.8
2009/0058033 A1 * 3/2009 Tomlinson ..... 280/200
2009/0144927 A1 * 6/2009 Yoo et al. ..... 15/300.1

* cited by examiner

*Primary Examiner* — Jean F Duverne
(74) *Attorney, Agent, or Firm* — L.C. Begin & Associates, PLLC.

(57) ABSTRACT

A power outlet organizer for an intravenous pole assembly may include a housing, at least one electrical outlet, an electrical cord, a biasing member, a support mechanism and a fastener. The electrical cord may include a first end portion electrically connected to the at least one electrical outlet and a second end portion electrically connected to an electrical plug. The electrical cord may be movable between a retracted position within the housing and an extended position for connecting the electrical plug to a wall socket. The biasing member may be configured to move the electrical cord to the retracted position. The support mechanism may include an elongated support structure carried by the housing and a plurality of brackets configured on the elongated support structure. Each bracket may be adapted for receiving a power cord of a medical device therein to preclude scattering thereof on a floor.

1 Claim, 6 Drawing Sheets

POWER OUTLET ORGANIZER

CROSS REFERENCE TO RELATED APPLICATION

This application claims the benefit of U.S. Provisional Application No. 61/100,344 filed on Sep. 26, 2008, the disclosure of which is incorporated by reference.

FIELD OF THE DISCLOSURE

The present invention generally relates to power outlets, and more particularly, to a power outlet organizer adapted for an intravenous pole assembly.

BACKGROUND OF THE DISCLOSURE

A power outlet is an interface used for providing electric power to electrically-operated devices. Examples of an electrically-operated device may include a fan, an air conditioning unit, an incubator, an infusion pump, and the like.

The infusion pump is used for infusing fluids, medication or nutrients, into a patient's intravenous (IV) line. Generally, the infusion pump is supported by an IV pole assembly. Sometimes, multiple infusion pumps may be used simultaneously. Generally, these multiple infusion pumps get electric power from the power outlet, such as a wall socket, in a treatment room. However, multiple power cords of these infusion pumps strewn around the patient room may create obstacles for people, such as doctors, nurses and caregivers, who move in the treatment room. Further, these power cords may also disrupt infusion of the fluids, medication or nutrients into the patient's IV line, as the power cords may need to be unplugged from the wall socket when the patient performs every day tasks, such as using the bathroom.

SUMMARY OF THE DISCLOSURE

One embodiment of a power outlet organizer for an intravenous pole assembly may include a housing. The housing may have one or more apertures, an orifice and a chamber communicated with the apertures and the orifice. The organizer may also have one or more electrical outlets that may be carried by the housing and received within the apertures. The organizer may further include an electrical cord having a first end portion electrically connected to the electrical outlets, and a second end portion electrically connected to an electrical plug. The electrical cord may be movable through the orifice between a retracted position within the chamber and an extended position for connecting the electrical plug to a wall socket and providing electrical power to the electrical outlets. The organizer may also have a biasing member that may be carried by the housing and configured to move the electrical cord to the retracted position. The organizer may also have a support mechanism that may include an elongated support structure that may be carried by the housing and a plurality of brackets configured on the elongated support structure. Each bracket may be adapted to receive a power cord of a medical device therein to preclude scattering of the power cord on a floor. The organizer may also have a fastener that may be carried by the housing and adapted to removably mount the organizer on the intravenous pole assembly.

BRIEF DESCRIPTION OF THE DRAWINGS

These and other features and advantages of the present disclosure will be apparent from the following detailed description of preferred embodiments and best mode, appended claims, and accompanying drawings in which:

Like reference numerals refer to like parts throughout the description of several views of the drawings.

DETAILED DESCRIPTION OF THE DISCLOSURE

The exemplary embodiments described herein provide detail for illustrative purposes and are subject to many variations in structure and design. It should be emphasized, however, that the present disclosure is not limited to a particular power outlet organizer, as shown and described. It is understood that various omissions and substitutions of equivalents are contemplated as circumstances may suggest or render expedient, but these are intended to cover the application or embodiment without departing from the spirit or scope of the claims of the present disclosure. Also, it is to be understood that the phraseology and terminology used herein are for the purpose of description and should not be regarded as limiting.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

Referring to FIGS. 1-4, one embodiment of a power outlet organizer 1000 is shown, that may be adapted to be mounted to an intravenous (IV) pole assembly (not shown).

Figure 1:
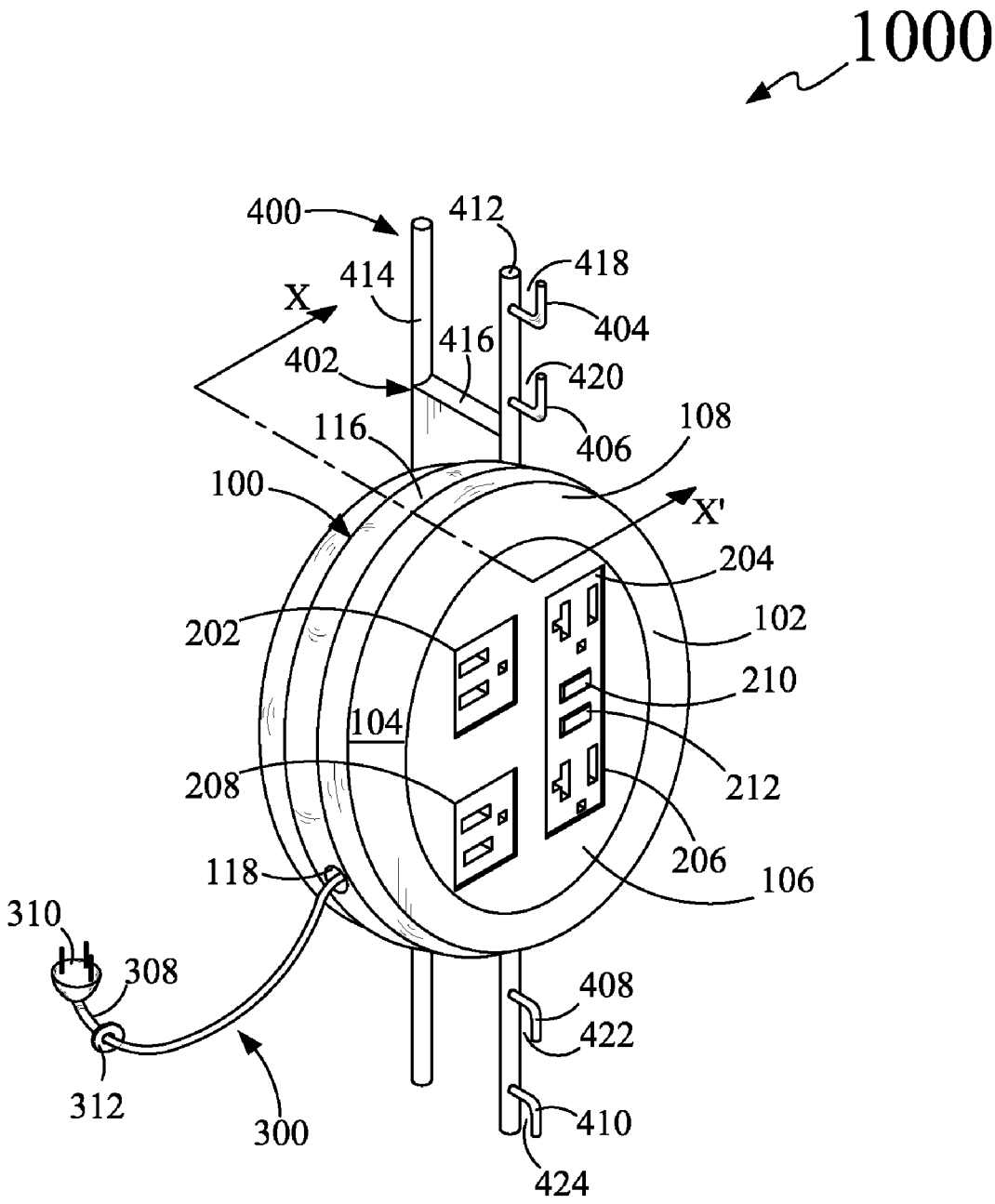
FIG. 1 is a perspective view of an embodiment of a power outlet organizer.
Figure 2:
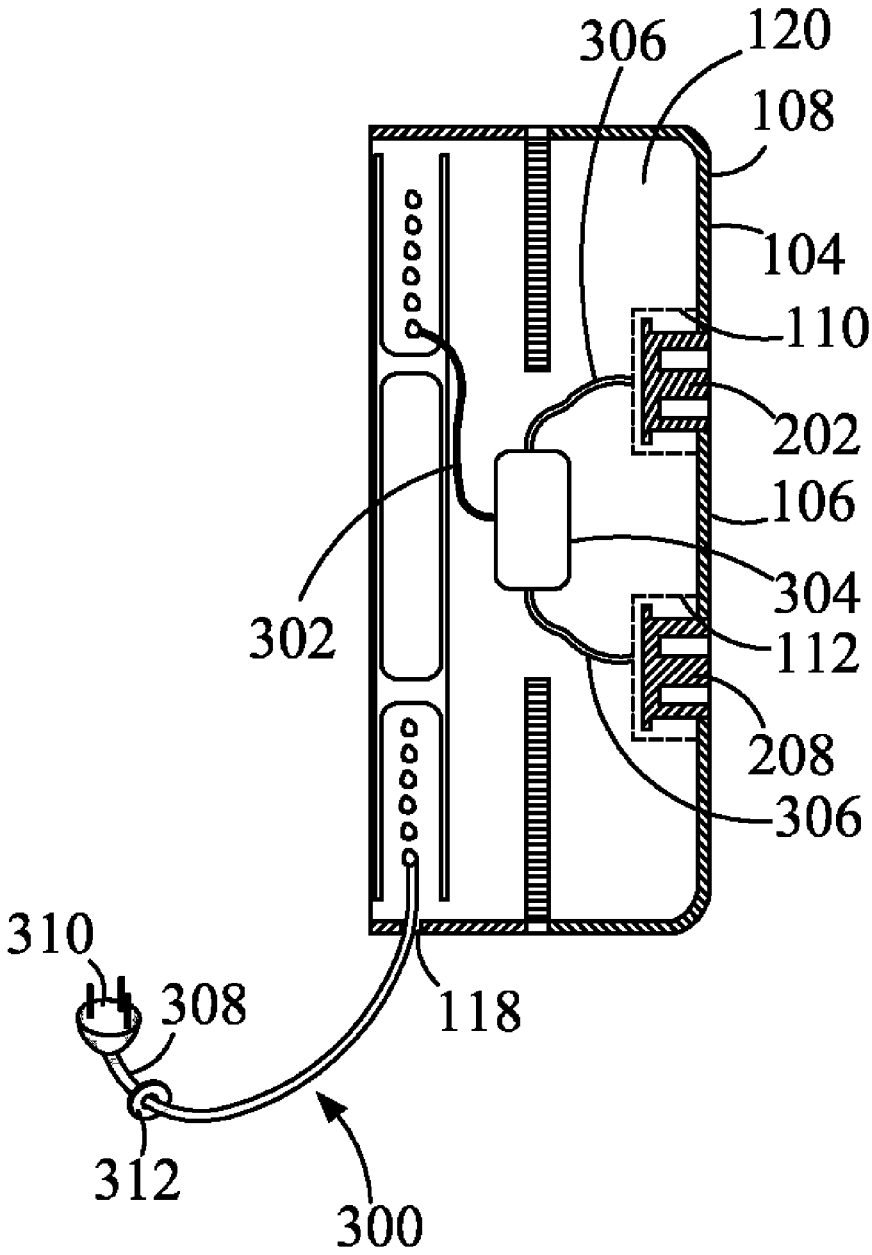
FIG. 2 is a sectional view of the power outlet organizer of FIG. 1 along a sectional line X-X', showing the power outlet organizer having a housing including at least one aperture, an orifice and a chamber communicated with the at least one aperture and the orifice.

Referring to FIGS. 1 and 2, the power outlet organizer 1000 may include a housing 100 having a cylindrical shape. Alternatively, the housing 100 may be configured to have various other shapes such as a cubical shape, a trapezoidal shape, or any other suitable shape. The housing 100 may include a front portion 102 having a surface 104. The surface 104 may include a central portion 106 that may have one or more apertures. As best shown in FIG. 2, the apertures in one form may include a first aperture 110 and a second aperture 112. Of course, the central portion 106 may have more or less apertures. The surface 104 may also include a peripheral portion 108 disposed about the central portion 106. The housing 100 may further have a rear portion 114 opposite to the front portion 102. In addition, the housing 100 may also have a side portion 116, which may extend between the front and rear portions 102, 114, and have an orifice 118. Further, the housing 100 may define a chamber 120 (shown in FIG. 2) between the front portion 102, the rear portion 114 and the side portion 116. The chamber 120 may be communicated with the apertures and the orifice 118 during assembly.

As best shown in FIG. 2, the power outlet organizer 1000 may also have one or more electrical outlets carried by the housing 100. The electrical outlets may include a first electric outlet 202 that may be received in the first aperture 110, a second electric outlet 204 combined with a third electric outlet 206 that may be received in an elongated aperture (not shown) and a fourth electric outlet 208 that may be received in the second aperture 112. Of course, the electrical outlets may include more or less outlets. The electrical outlets may include slots (not numbered) that are adapted to deliver currents to prongs of inserted plugs of various electrically-operated devices, such as infusion pumps. Further, one or more of the electrical outlets in this form may be ground fault interrupter outlets ("GFI outlets") that may be configured to detect an imbalance of current and automatically trip a breaker (not shown) when the outlet detects the imbalance of current. For example, the second and third electrical outlets 204, 206 may be GFI outlets operatively coupled to the breaker. The second and third electrical outlets 204, 206 may further include a TEST button 210 that may be operatively coupled to the breaker and pressed to manually trip the breaker. In addition, the second and third electrical outlets 204, 206 may also include a RESET button 212 operatively coupled to the breaker and/or the TEST button 210 to reset the breaker for continuing the supply of electrical current and return the TEST button 210 to its original position.

Referring still to FIG. 2, the power outlet organizer 1000 may also have an electrical cord 300 ("cord 300") that may include a first end portion 302 that may be electrically connected to the electrical outlets. For example, the first end portion 302 may be connected to a common electrical point 304. The common electrical point 304 may be electrically connected to the electrical outlets by means of electric wires, such as an electric wire 306. More specifically, the common electrical point 304 is adapted to distribute electric power to the electrical outlets. Alternatively, the first end portion 302 may be electrically connected to the electrical outlets by various means and mechanisms known in the art. The cord 300 may further have a second end portion 308, which may be electrically connected to an electrical plug 310. The electrical plug 310 may be adapted to be connected to a wall socket (not shown) for providing electrical power to the electrical outlets.

Further, the cord 300 may be movable through the orifice 118 between a retracted position within the chamber 120 and an extended position for connecting the electrical plug 310 to the wall socket and providing electric power to the electrical outlets. More specifically, when there is no requirement of providing electric power to the electric outlets, the cord 300 is adapted to be retained inside the housing 100 in the retracted position. Alternatively, in the extended position, a portion (not numbered) of the cord 300 is moved away from the housing 100, such that the electrical plug 310 may be connected to the wall socket for providing the electric power to the electrical outlets. Further, the cord 300 may include a stopper member 312 disposed circumferentially on the second end portion 308. The stopper member 312 may be an annular flange or ring carried by a portion of the cord 300 adjacent to the electrical plug 310. However, the stopper member 312 may be carried by other portions of the cord 300 by moving the stopper member 312 along the cord 300. The stopper member 312 may be adapted to prevent complete retraction of the cord 300 into the housing 100.

The power outlet organizer 1000 may also have a support mechanism 400 that may be carried by the rear portion 114 of the housing 100. The support mechanism 400 may include an elongated support structure 402 ("support 402"), which in one form may include a first elongated member 412. The first elongated member 412 may have a center portion coupled to the rear portion 114 by welding and opposing end portions freely suspended by the center portion. Of course, the first elongated member 412 may instead be joined with the rear portion 114 by brazing or other suitable fastening methods. The coupling between the first elongated member 412 and the rear portion 114 is such that the support 402 extends perpendicularly from the rear portion 114 of the housing 100 (shown in FIG. 3). Further, the support 402 may also include a second elongated member 414 positioned parallel to the first elongated member 412.

The support 402 may also include a joining member 416 that joins the second elongated member 414 to the first elongated member 412. The joining member 416 may be adapted for carrying the cord 300 and one or more power cords (not shown) of one or more medical devices. For example, the joining member 416 in one form may be a flat plate, such that the cords may be wrapped around the joining member 416 and clipped to one or more brackets 404, 406, 408, 410 to prevent scattering of the cords on the floor. Of course, the joining member 416 may instead be a non-flat plate or have various other suitable carrier configurations.

Figure 3:
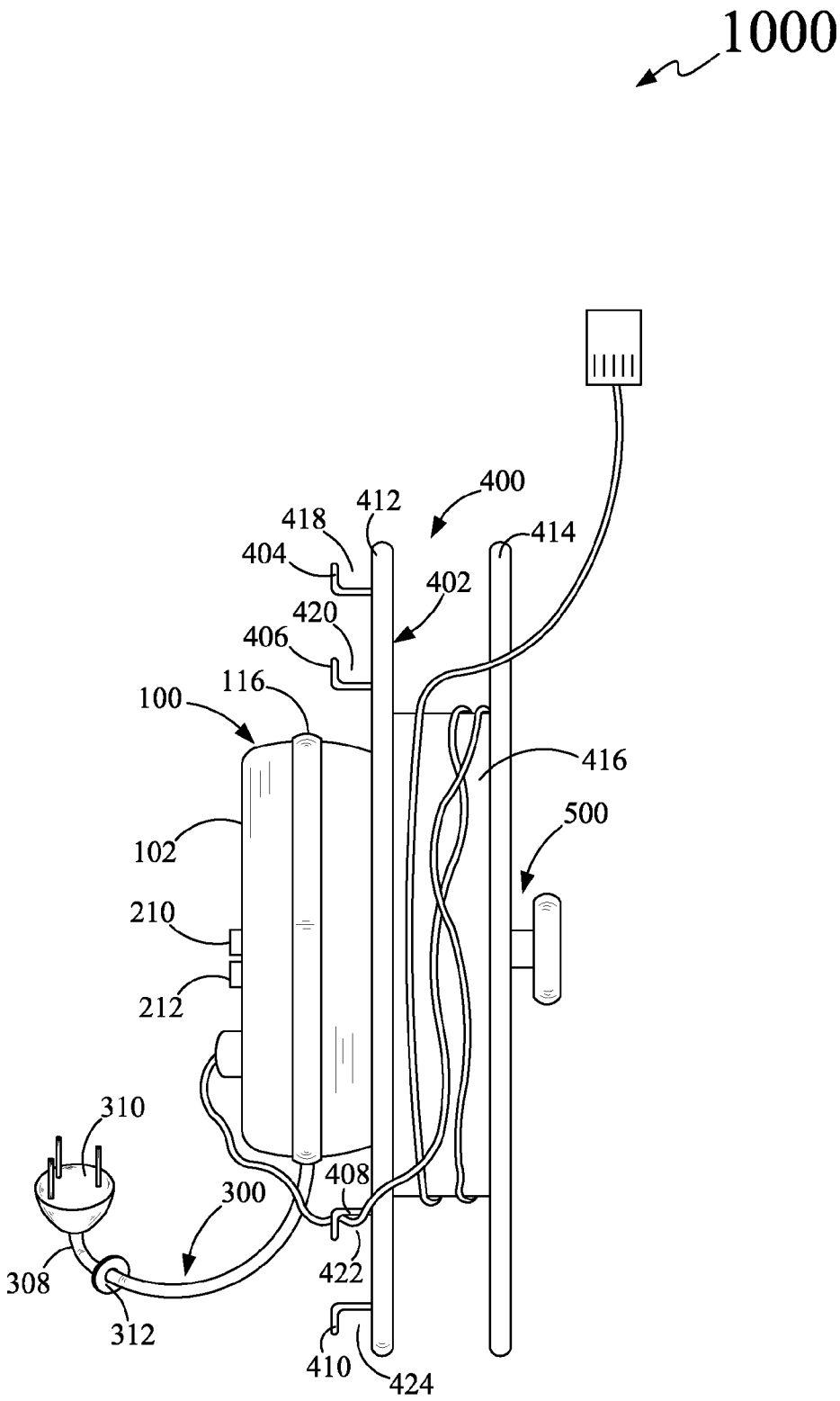
FIG. 3 is a side view of the power outlet organizer of FIG. 1, showing the power outlet organizer having a support mechanism carried by the housing.

As best shown in FIGS. 1-3, the support mechanism 400 may further include a plurality of brackets, such as a first bracket 404, a second bracket 406, a third bracket 408 and a fourth bracket 410. The first and second brackets 404, 406 may be carried by one end portion of the first elongated member 412, such that these two brackets are positioned above the housing 100. Similarly, the third and fourth brackets 408, 410 may be carried by another end portion of the first elongated member 412, such that these two brackets are positioned below the housing 100. However, the brackets may instead be carried by other portions of the first elongated member 412 or the second elongated member 414.

As best shown in FIG. 3, the first and second brackets 404, 406 may be L-shaped to define a respective one of open end portion 418 and open end portion 420. The first and second brackets 404, 406 may extend from the first elongated member 412 such that the open end portions 418, 420 extend in a direction away from the housing 100. Further, the third and fourth brackets 408, 410 may be L-shaped to define a respective one of open end portion 422 and open end portion 424. The brackets 404, 406 may extend from the first elongated member 412 such that the open end portions 422, 424 extend in a direction away from the housing 100. Of course, the brackets may have any other shape, such as a C-shape. Further, each bracket may be adapted for receiving the power cord and the cord 300 therein to prevent scattering of the power cord and the cord 300 on a floor.

Figure 4:
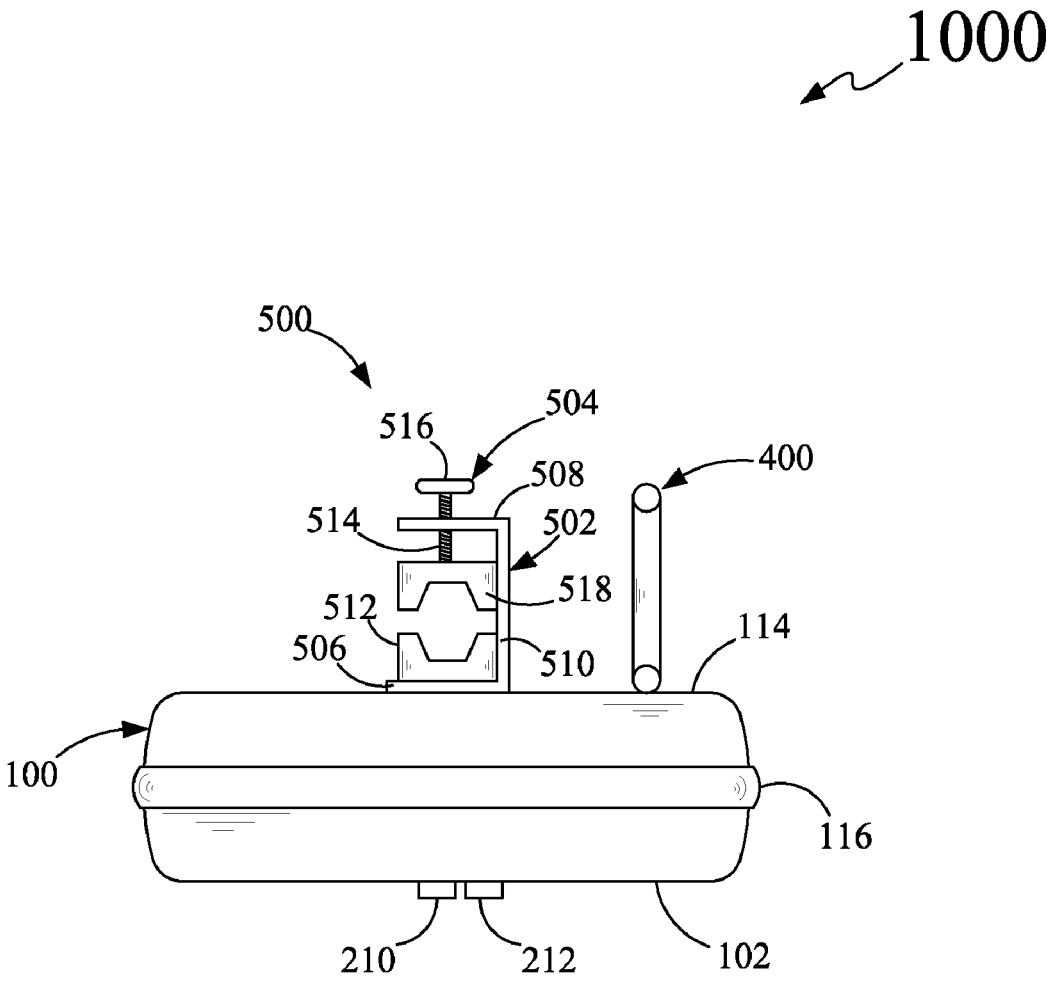
FIG. 4 is a top view of the power outlet organizer of FIG. 1, showing the power outlet organizer having a fastener.

Referring to FIGS. 3 and 4, the power outlet organizer 1000 may also have a fastener 500 carried by the housing 100. The fastener 500 in one form may be a clamp 502. The clamp 502 may be a C-shaped bracket having a first end 506 carried by the housing 100 by any suitable fastening method, such as welding, brazing, and the like. The clamp 502 may also have a second end 508, which may be spaced apart from the first end 506 and may include a threaded hole (not shown) therein. Further, the clamp 502 may also have a first grip member 512 carried by the first end 506. In addition, the clamp 502 may also include a knob mechanism 504 having a threaded rod 514 received in the threaded hole of the second end 508. The threaded rod 514 may include a first end portion (not numbered) and a second end portion (not numbered) opposite to the first end portion. The knob mechanism 504 may further include a knob 516 that may be carried by the first end portion of the threaded rod 514. The knob 516 may be adapted to provide a gripping area to a user for rotating the threaded rod 514 in the threaded hole. Further, the knob mechanism 504 may also include a second grip member 518 carried by the second end portion of the threaded rod 514. The first and second grip members 512, 518 may be adapted for mounting the IV pole assembly therebetween. It is contemplated that the fastener 500 may be any other suitable fasteners, such as a clip, a hook, and the like.

Figure 5:
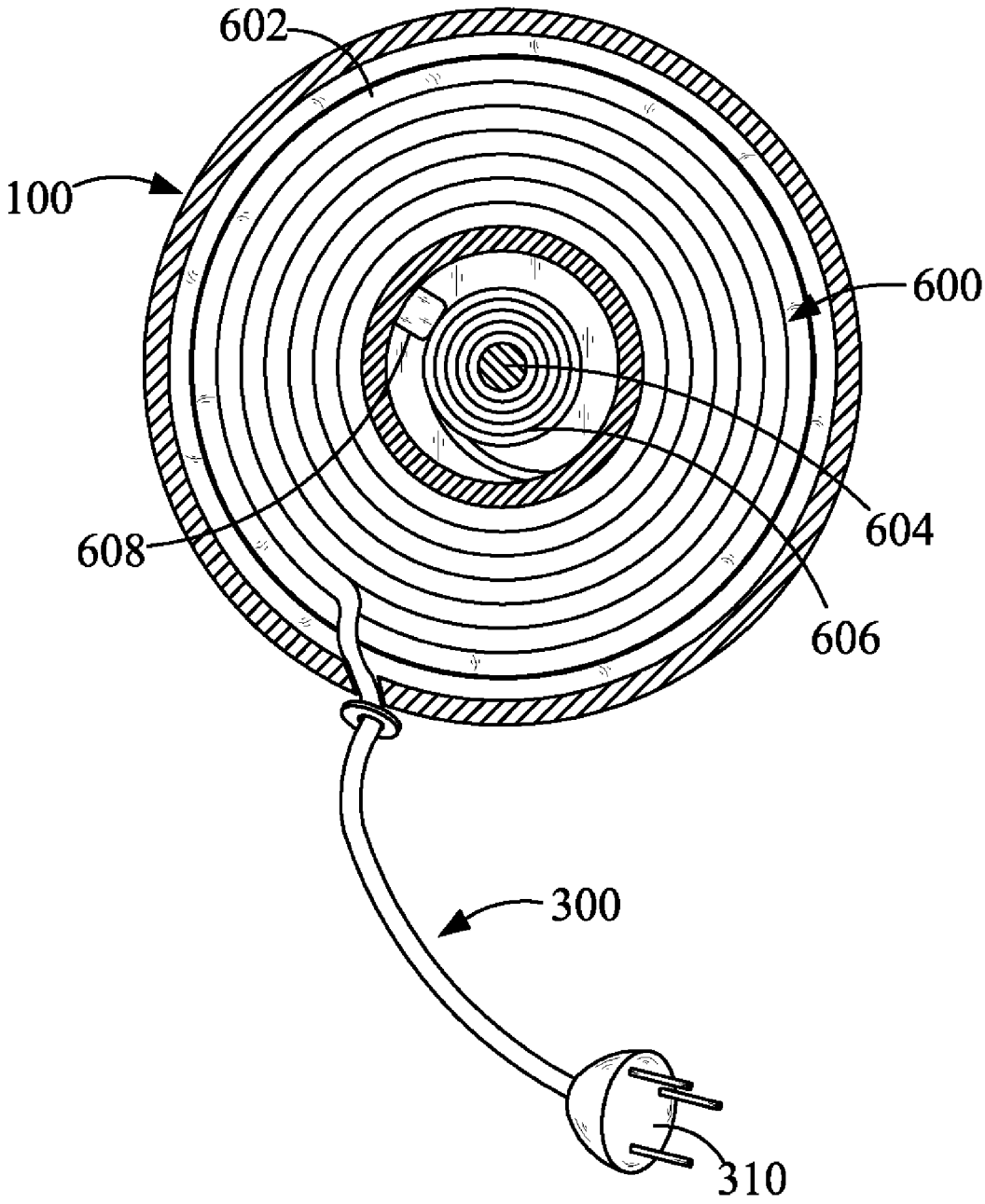
FIG. 5 is a sectional view of the power outlet organizer of FIG. 1, showing the power outlet organizer having an electrical cord and a biasing member configured to retract the electrical cord within the housing.

Referring now to FIG. 5, the power outlet organizer 1000 may also have a biasing member 600 that may be carried by the housing 100 and configured to move the cord 300 to the retracted position. The biasing member 600 in one form may include an axle 604 carried by the housing 100. The biasing member 600 may also have a reel 602 configured to rotate about the axle 604 and carry the cord 300 by, for example, wrapping the cord 300 around the reel 602. Further, the biasing member 600 may also include a torsional spring 606 coupled to the reel 602 to rotate the reel 602 in one direction, such that the reel 602 may retract the cord 300 into the housing 100. Alternatively, the reel 602 may be rotated by means of a hand crank or a motor to retract the cord 300 into the housing 100. Furthermore, the biasing member 600 may also include a retraction locking mechanism 608. The retraction locking mechanism 608 may be carried by the reel 602 and may be configured to lock the cord 300 around the reel 602 when the cord 300 is extended out of the housing 100 so that only a desired amount of the cord 300 extends from the housing 100. The retraction locking mechanism 608 may unlock the cord 300 when the cord 300 is being pulled out of the housing 100. Further, the retraction locking mechanism 608 may re-lock the cord 300 once the cord 300 has been pulled out of the housing 100.

Figure 6:
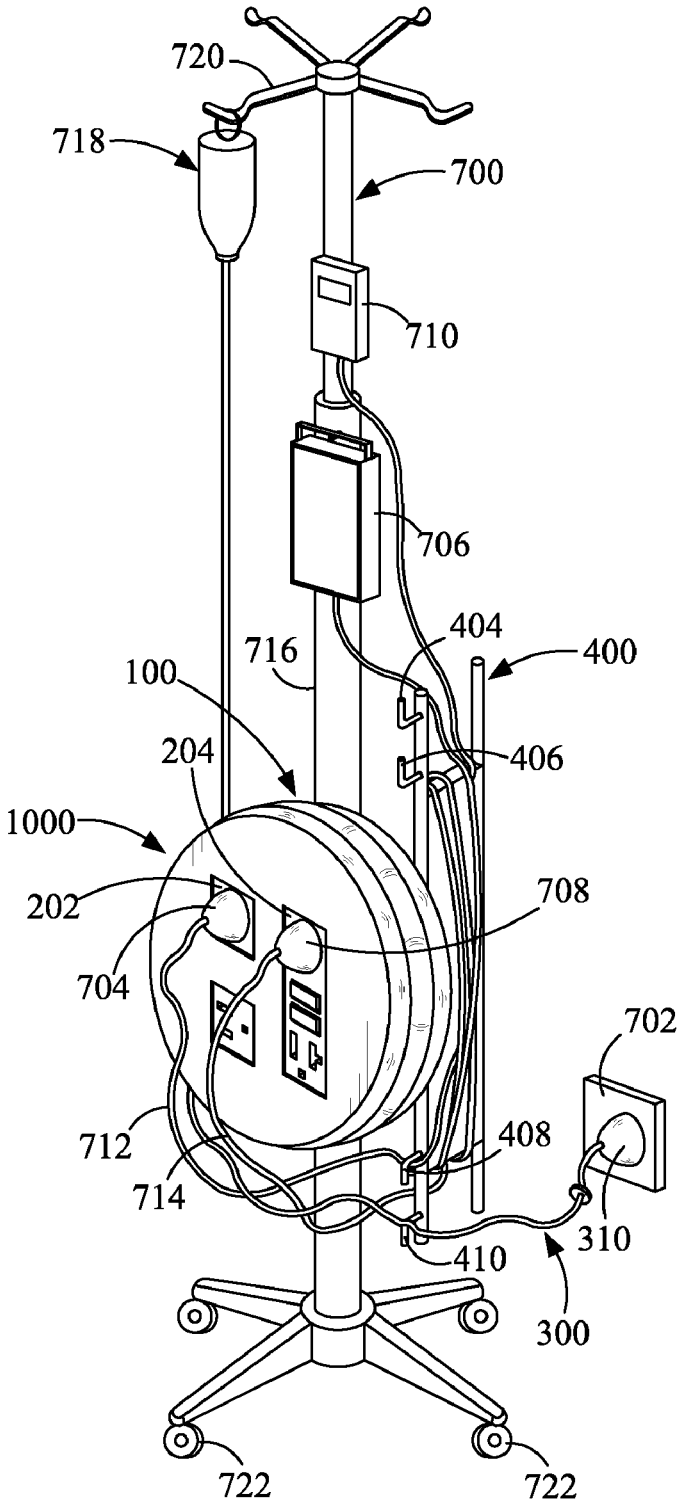
FIG. 6 is a perspective view of the power outlet organizer of FIG. 1 mounted on an intravenous pole assembly.

In use, as shown in FIG. 6, the power outlet organizer 1000 may be mounted to an IV pole assembly 700 by means of the fastener 500, with the electrical plug 310 connected to the to a wall socket 702. The IV pole assembly 700 may include a first infusion pump 706 ("pump 706") that may have a power plug 704 connected to the first electric outlet 202. Further, the pump 706 may have another power cord 712 that may be wrapped around the second bracket 406 and the third bracket 408. Similarly, IV pole assembly 700 may include a second infusion pump 710 ("pump 710") having a power plug 708 connected to the second electric outlet 204. The pump 710 may have another power cord 714 wrapped around the first bracket 404 and the fourth bracket 410.

Further, in the extended position, the cord 300 may also be wrapped around a single bracket, such as the second bracket 406, or between two brackets. Accordingly, each bracket may be adapted for receiving one of the power cords 712, 714, and the cord 300 therein to preclude scattering of these cords on the floor of the treatment room.

As shown in FIG. 6, the IV pole assembly 700 may include a stand 716, an IV drip system 718, at least one hanger, such as a hanger 720, and a plurality of wheels 722. The stand 716 forms a support structure for supporting the power outlet organizer 1000 thereon. The IV drip system 718 may be suspended from the stand 716 though the hanger 720. The plurality of wheels 722 may be configured to provide portability of the IV pole assembly 700. It will be evident that the IV pole assembly 700 may include more or less elements as known in the art.

The power outlet organizer 1000 may be beneficial for preventing electric cords from scattering on a floor of a treatment room. Specifically, the power outlet organizer prevents accidents from occurring. Further, the power outlet organizer increases safety of people and medical devices. Furthermore, the power outlet organizer enables a patient to perform every day tasks, such as eating, using the bathroom and the like. Still further, the power outlet organizer may be portable. Moreover, the power outlet organizer may be simple in construction and easy to use.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, and to thereby enable others skilled in the art to best utilize the present invention and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the spirit or scope of the claims of the present invention.

What is claimed is:

1. A power outlet organizer for an intravenous pole assembly, the power outlet organizer comprising:

a housing having at least one aperture, an orifice and a chamber communicated with the at least one aperture and the orifice;

at least one electrical outlet carried by the housing and received within the at least one aperture;

an electrical cord having a first end portion electrically connected to the at least one electrical outlet, the electrical cord further having a second end portion electrically connected to an electrical plug, wherein the electrical cord is movable through the orifice between a retracted position within the chamber and an extended position for connecting the electrical plug to a wall socket and providing electrical power to the at least one electrical outlet;

a biasing member carried by the housing and configured to move the electrical cord to the retracted position;

a support mechanism comprising an elongated support structure carried by the housing and a plurality of brackets configured on the elongated support structure, each of the plurality of brackets adapted for receiving a power cord of a medical device therein to preclude scattering of the power cord on a floor; and a fastener carried by the housing, wherein the fastener is adapted for removably mounting the power outlet organizer on the intravenous (IV) pole assembly, wherein the fastener comprises a clamp bracket carried by the housing and a knob mechanism carried by the clamp bracket, the knob mechanism and the clamp bracket configured to be removably mounted on the IV pole assembly positioned therebetween, wherein the clamp bracket comprises, a first brace member carried by the housing, a second brace member configured substantially parallel to the first brace member, the second brace member adapted for carrying the knob mechanism, a third brace member adapted for connecting the first brace member to the second brace member, and a clamp grip member carried by the first brace member and adapted for mounting on the IV pole assembly.

* * * * *